United States Patent [19]

Koch et al.

[11] 4,429,567

[45] Feb. 7, 1984

[54] APPARATUS FOR TESTING CIGARETTES OR THE LIKE

[75] Inventors: Franz P. Koch, Schwarzenbek; Adolf Helms, Hamburg; Wolfgang Siems, Hamburg; Peter Brand, Hamburg, all of Fed. Rep. of Germany

[73] Assignee: Hauni-Werke Körber & Co. KG, Hamburg, Fed. Rep. of Germany

[21] Appl. No.: 317,419

[22] Filed: Nov. 2, 1981

[30] Foreign Application Priority Data

Nov. 3, 1980 [DE] Fed. Rep. of Germany ..... 3041217

[51] Int. Cl.[3] ..... G01M 3/00

[52] U.S. Cl. ..... 73/49.8; 73/38; 73/45.1; 138/96 R

[58] Field of Search ..... 220/DIG. 19; 73/38, 73/41, 45, 45.1, 45.2, 49.8; 277/212 C, DIG. 2; 138/96 R, 96 T; 285/260

[56] References Cited

U.S. PATENT DOCUMENTS 3,769,832 11/1973 Baier ..... 73/49.8 X 3,914,989 10/1975 Reuland et al. ..... 73/45.1 X 3,948,084 4/1976 Heitmann et al. ..... 73/49.8 X

*Primary Examiner*—Gerald Goldberg

*Assistant Examiner*—Brian Tumm

*Attorney, Agent, or Firm*—Kontler, Grimes & Battersby

[57] ABSTRACT

A cigarette testing apparatus wherein a rotary drum-shaped conveyor has axially parallel peripheral flutes for cigarettes and is flanked by two swash plates which rotate therewith and carry annuli of elastically deformable sealing elements for the respective ends of cigarettes on the conveyor. Each sealing element has a socket facing the adjacent end of the cigarette in the corresponding flutes of the conveyor when the cigarette is inserted into the flutes. The swash plates thereupon move the sealing elements nearer to the ends of the cigarettes therebetween whereby the ends of the cigarettes enter the corresponding sockets and displace transversely extending partitions of the sealing elements with attendant radial contraction of those tubular sections of the sealing elements which surround the respective sockets. This moves the internal surfaces of such sections into sealing engagement with the external surfaces of the ends of the cigarettes during transport of cigarettes through the testing station where the cigarettes receive streams of testing fluid flowing through centrally located apertures of the adjacent partitions. The sealing elements have thin-walled annular membranes flanking the respective partitions to allow for movement of the partitions in response to the application of pressure by the respective ends of a cigarette as well as to facilitate radial deformation of the tubular sections in response to such displacement of the partitions. The sealing elements reassume their undeformed states when they move away from the respective ends of the cigarette therebetween in response to further rotation of the swash plates.

17 Claims, 2 Drawing Figures

APPARATUS FOR TESTING CIGARETTES OR THE LIKE

BACKGROUND OF THE INVENTION

The present invention relates to apparatus for testing rod-shaped articles of the tobacco processing industry, especially for testing the wrappers and/or other portions of plain or filter cigarettes, cigars or cigarillos while the articles travel along a predetermined path and past a testing station. More particularly, the invention relates to improvements in testing apparatus of the type wherein at least one end of each article to be tested is engaged by an elastic sealing element which serves to admit a testing fluid into or to convey a testing fluid from the respective end of the article.

It is already known to admit the articles to be tested into peripheral flutes of a rotary drum-shaped conveyor which transports the articles past the testing station. The condition of the wrappers of articles can be tested by admitting a stream of testing fluid into one or both ends of an article which travels past the testing station and by ascertaining the drop of pressure (if any), i.e., whether or not the wrapper of the article which moves past the testing station has one or more holes, an open seam, a frayed end or a combination of such defects. At least one end of the wrapper of the article must be sealed from the surrounding atmosphere during testing, and such sealing is achieved by resorting to the aforementioned elastic sealing elements which orbit about the axis of the testing conveyor and have sockets for reception of the adjacent ends of the articles. The sealing elements consist of rubber or an elastomeric synthetic plastic material. Furthermore, the testing conveyor is equipped with means for effecting a movement of the sealing elements into engagement with the respective ends of the articles not later than during travel past the testing station and for thereupon disengaging the articles from the sealing elements preparatory to removal of articles from the testing conveyor. This can be accomplished by moving the sealing elements axially of the articles (i.e., in parallelism with the axis of the testing conveyor) under the action of followers which track one or more stationary cams or by providing mobile cams, e.g., in the form of swash plates or the like.

It is further desirable to test the wrappers of cigarettes or analogous rod-shaped articles in order to ascertain the permeability of their so-called climatic zones, i.e., of zones which are formed with intentionally produced perforations. The perforations serve to admit cool atmospheric air into the column of tobacco smoke, and their number as well as their diameters must be constant from cigarette to cigarette because minor and even minute deviations of the desired rate of inflow of cold air from the actual rate are unacceptable to the makers of smokers' products. Therefore, the testing apparatus must operate with a high degree of accuracy because the flow of any, even minute, quantities of atmospheric air as a result of unsatisfactory sealing action in the course of the testing operation can cause the apparatus to furnish highly distorted readings regarding the quality of tested articles with the result that long series of satisfactory articles are segregated together with defective articles or that large numbers of defective articles remain undetected.

Elastic sealing elements which are used for the above outlined purposes are disclosed, for example, in commonly owned U.S. Pat. No. 3,386,281 granted June 6, 1968 to Menge et al. and in commonly owned U.S. Pat. No. 3,769,832 granted Nov. 6, 1973 to Baier. Testing apparatus which serve to ascertain the permeability of so-called climatic zones in the wrappers of filters in filter cigarettes or the like are disclosed, for example, in commonly owned U.S. Pat. No. 4,177,670 granted Dec. 11, 1979 to Heitmann et al. A further apparatus which is used for the testing of cigarettes or the like and wherein the testing conveyor is constructed in a manner similar to that disclosed in the present application is described in commonly owned U.S. Pat. No. 3,948,084 granted Apr. 6, 1976 to Heitmann et al. The disclosures of the aforementioned patents are incorporated herein by reference. The assignee of the present application owns numerous additional U.S. as well as foreign patents and pending patent applications dealing with the testing of cigarettes, filter rod sections, cigars, cigarillos and/or other rod-shaped articles which constitute or form part of smokers' products.

A drawback of many presently known elastic sealing elements for the end portions of cigarettes or the like is that they must be deformed by pneumatic and/or mechanical means in order to move into satisfactory sealing engagement with the end faces and/or external surfaces of the articles to be tested. The means for effecting deformation of sealing elements into adequate engagement with the articles to be tested contribute to the complexity, bulk and cost of the testing apparatus. Furthermore, such deformation effecting means must be serviced and inspected at frequent intervals and are prone to malfunction so that they are a cause of frequent and protracted down times of the machine (e.g., a filter tipping machine) wherein the testing apparatus is installed.

OBJECTS AND SUMMARY OF THE INVENTION

An object of the invention is to provide a novel and improved testing apparatus for cigarettes or analogous rod-shaped articles.

Another object of the invention is to provide the testing apparatus with novel and improved means for sealingly engaging the end portions of articles during testing.

A further object of the invention is to provide highly reliable, simple, compact and inexpensive sealing elements for the end portions of plain or filter cigarettes, cigars, cigarillos, filter rod sections or analogous commodities.

An additional object of the invention is to provide elastic sealing elements which need not be deformed into sealing engagement with the articles to be tested by resorting to discrete deforming or compressing means.

Still another object of the invention is to provide sealing elements which can be installed in certain existing testing apparatus as superior substitutes for presently used sealing elements.

A further object of the invention is to provide sealing elements which can be used with particular advantage in high-speed machines for the production and/or processing of rod-shaped smokers' products, such as filter cigarettes.

An additional object of the invention is to provide sealing elements which can be used in a testing apparatus for cigarettes or the like irrespective of whether the apparatus is designed to ascertain defects which are attributable to accidentally formed holes or to improper dimensioning and/or distribution of intentionally formed perforations or the like.

A further object of the invention is to provide a testing apparatus which embodies the above outlined sealing elements and can be used with advantage in filter tipping or analogous machines.

One feature of the invention resides in the provision of an apparatus for testing cigarettes or analogous rod-shaped articles, for example, in a filter tipping machine or in a machine for the production of plain cigarettes. The apparatus comprises an article transporting conveyor (for example, a substantially drum- or wheel-shaped conveyor with axially parallel peripheral flutes for the articles to be tested), and at least one sealing element movable in synchronism with the conveyor and including a partition as well as an elastic tubular section which is adjacent to and defines with the partition a socket for one end of an article on the conveyor. The tubular section has an internal surface which surrounds the socket and is contractible radially inwardly in response to deformation of the tubular section and attendant reduction of its inner diameter in response to displacement of the partition in a predetermined direction. The apparatus further comprises means (e.g., a swash plate which shares the movements of the conveyor) for effecting a relative movement between the conveyor and the sealing element or between the article on the conveyor and the sealing element so as to introduce the one end of the article into the socket and to thereupon cause the thus introduced end of the article to displace the partition in the aforementioned direction whereby the internal surface of the tubular section sealingly engages the external surface of the one end of the article.

The sealing element preferably comprises a substantially annular weakened portion of membrane which is disposed between the partition and the tubular section and serves to enhance the deformability of the tubular section in response to displacement of the partition.

The sealing element preferably further comprises a second tubular section, and the partition is then disposed between the two tubular sections. Each of the two tubular sections can have a weakened annular portion or membrane which is immediately or closely adjacent to the partition. The membrane of the second tubular section allows for movement or displacement of the partition in the predetermined direction (i.e., it allows for a reduction of the overall length of the sealing element). Thus, the membrane of the second tubular section reduces the resistance which the one end of the article encounters while moving the partition in the predetermined direction. The wall thickness of each membrane may be a small fraction of the wall thickness of the remaining or major portions of the corresponding tubular sections. The cross section of the tubular section which surrounds the aforementioned socket preferably resembles a wedge, and the thickness of this tubular section preferably decreases in a direction away from the partition to terminate in a relatively thin ring-shaped lip which sealingly engages the external surface of the article in response to displacement of the partition under the action of the one end of the article.

The outer side or surface of the partition (i.e., that side which faces the socket) is preferably flat, and the internal surface of the tubular section which surrounds the socket is preferably a cylindrical surface whose axis is normal to the outer side of the partition in undeformed condition of such tubular section. The just discussed cylindrical surface is normally converted into a substantially frustoconical surface in response to displacement of the partition in the predetermined direction, and the diameter of such frustoconical surface decreases in a direction away from the partition. The partition is preferably formed with at least one aperture (e.g., with a centrally located aperture) for the passage of a stream of gaseous testing fluid therethrough. Such fluid can flow into the one end of the article or from the one end of the article, depending on the design of the testing apparatus.

Another feature of the invention resides in the provision of a sealing element which exhibits the aforediscussed characteristics, i.e., which has a substantially tubular body including two tubular sections and a transverse partition between the two tubular sections. One of the tubular sections surrounds the aforementioned socket, and the other tubular section can be used to secure the sealing element to a nipple or another support on the aforementioned swash plate.

The novel features which are considered as characteristic of the invention are set forth in particular in the appended claims. The improved testing apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
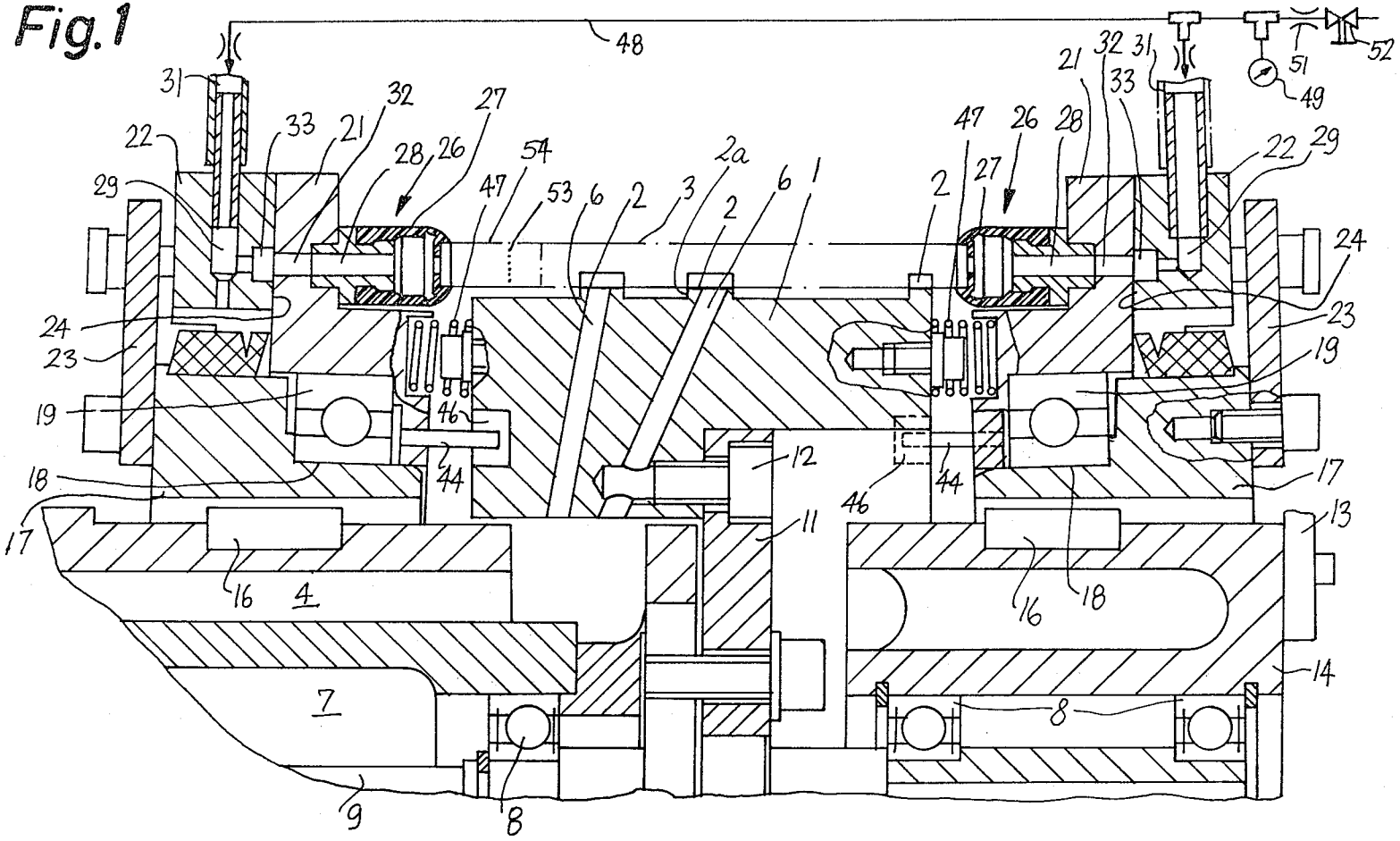
FIG. 1 is a fragmentary axial sectional view of a testing apparatus with sealing elements which embody the invention.

The testing apparatus which is shown in FIG. 1 comprises a rotary drum-shaped testing conveyor 1 which is installed in a filter tipping machine, e.g., a machine known as MAX or MAX S produced and sold by the assignee of the present application. Reference may be had to FIG. 1 of the aforementioned U.S. Pat. No. 3,948,084 which shows a MAX machine, and to FIG. 1 of the aforementioned U.S. Pat. No. 4,177,670 which a MAX S machine. The filter tipping machine has means for assembling pairs of plain cigarettes of unit length with filter rod sections of double unit length so as to form filter cigarettes of double unit length, means for subdividing each filter cigarette of double unit length into two filter cigarettes of unit length, and a testing apparatus which embodies the present invention and is designed to generate signals identifying those filter cigarettes of unit length which are defective for any one of several reasons such as the presence of holes, open seams or frayed ends in their wrappers, unsatisfactory permeability of intentionally produced perforations in the filter cigarettes and/or leaks in regions where the tobacco-containing portions of filter cigarettes are connected to the respective filter plugs.

The periphery of the conveyor 1 has several circumferentially extending ribs 2*a* which are formed with axially parallel receiving means or flutes 2 for temporary reception and retention of the articles 3 (filter cigarettes) to be tested. At least some of the flutes 2 communicate with suction ports 6 which are machined into the body of the conveyor 1 and communicate with one or more axially parallel or coaxial channels 4 machined into a stationary support 7 for the conveyor 1. The channel or channels 4 are connected with a suitable suction generating device (such as a suction fan) in order to attract the articles 3 to the surfaces surrounding the respective flutes 2 during that stage of transport of the articles when they advance past the testing station. In the embodiment which is shown in FIG. 1, the testing station is located at or close to the twelve o'clock position of the conveyor 1 (it being assumed here that the axis of rotation of the conveyor 1 is horizontal and is located in the plane of FIG. 1).

The support 7 extends into an axial bore of the conveyor 1 and coaxially surrounds a rotary driver shaft 9 which rotates in several antifriction ball bearings 8. A median portion of the driver shaft 9 has a disc-shaped flange 11 which is rigidly secured to the conveyor 1 by an annulus of screws 12 or analogous fastener means.

The stationary support 7 is surrounded by one of two axially spaced ring-shaped bearing members 17 the other of which is non-rotably secured to a sleeve 14 surrounding the right-hand end portion of the drive shaft 9, as viewed in FIG. 1. The sleeve 14 is non-rotatably secured to the frame of the filter tipping machine by one or more levers 13, links or other suitable coupling elements. The bearing members 17 are held against rotation with reference to the supporting member 7 and sleeve 14 by keys 16. These bearing members have cylindrical external surfaces 18 which make acute angles with the axis of the driver shaft 9 and slope toward such axis in directions away from the respective ends and toward the center of the conveyor 1. The surfaces 18 are surrounded by the inner races of antifriction ball bearings 19 whose outer races are engaged by the internal surfaces of two swash plates 21 flanking the conveyor 1. Owing to the aforediscussed inclination of surfaces 18, the swash plates 21 are nearer to each other at the testing station and are more distant from each other at a location which is disposed diametrically opposite the testing station (i.e., at a level below FIG. 1). The inclination of both swash plates 21 is the same; however, these plates are inclined in the opposite directions.

The outer sides or surfaces of the swash plates 21 are engaged by complementary surfaces 24 of stationary arcuate valve plates 22 which flank the testing station and are affixed to the stationary bearing members 17 by links 23. In order to effect precision adjustments of the swash plates 21, the bearing members 17 can be shifted axially of the hollow support 7 and sleeve 14 whereby the keys 16 hold the bearing members 17 against angular movement. Such adjustment is necessary when the testing apparatus is to be set up to test a succession of relatively long articles subsequent to testing of a series of shorter articles, or vice versa. Suitable clamping or arresting means (not specifically shown) are provided to hold the bearing members 17 in the selected axial positions, i.e., at a selected distance from the respective axial ends of the conveyor 1.

Each of the swash plates 21 carries an annulus of elastically deformable tubular sealing elements 26 each of which has a tubular section 27 serving to engage the corresponding nozzle 28 which supplies a gaseous testing fluid to the respective end of a rod-shaped article 3 during travel past the testing station between the valve plates 22. The axial passages of the nozzles 28 (which are installed in the respective swash plates 21) receive testing fluid from channels or bores 29 machined into the corresponding valve plates 22. The channels 29 receive testing fluid from nipples 31 which are mounted on the valve plates 22. The two channels 29 communicate seriatim with those bores 32 of the swash plates 21 which travel between the valve plates 22. Each of the two valve plates 22 has an arcuate groove 33 which is machined into the respective surface 24 and extends along the path of the bores 32 to determine the effective length of the testing station. Thus, as a rod-shaped article 3 advances between the valve plates 22, its ends receive streams of a gaseous testing fluid from the nipples 31 by way of the corresponding channels 29, corresponding grooves 33 and the respective bores 32. The length of each of the arcuate grooves 33 is less than the distance between two neighboring articles 3 on the conveyor 1, i.e., less than the distance between two neighboring sets of registering flutes 2.

The sealing elements 26 consist of rubber or an elastomeric synthetic plastic material which is readily deformable in response to engagement with the end portions of articles 3. Such deformation involves automatic reduction of the diameters of tubular sections 38 (see FIG. 2) of the sealing elements 26 so that the relatively thin edge portions or lips 42 of the sections 38 sealingly engage the external surfaces **3*a* of tubular wrappers of the respective articles 3 in regions which are slightly spaced apart from the respective end faces 3*b*** of such articles.

Each sealing element 26 further comprises a transverse bottom wall or partition 34 which is disposed between the respective tubular sections 27, 38 and has a centrally located aperture 43 for admission of a stream of gaseous testing fluid against the end face **3*d* of the article 3 whose end portion is surrounded and sealingly engaged by the lip 42. The end face 3*b* of an article 3 which extends into the socket 40 surrounded by the tubular section 38 bears against the outer side or surface 36 of the partition 34. The arrangement is such that, when two aligned sealing elements 26 advance toward each other (as considered in parallelism with the axis of the conveyor 1) on their way toward the testing station between the valve plates 22, the two end faces 3*b* of the article 3 between such sealing elements bear against the outer sides 36 of the adjacent partitions 34 and push the partitions toward the corresponding nozzles 28 (see the arrow X in FIG. 2). This results in automatic sealing engagement between the lips 42 and the external surface 3*a* of the article 3 because the connection between the tubular section 27 of each sealing element 26 and the corresponding partition 34 includes a first weakened annular intermediate portion or membrane 41 of reduced thickness which allows the partition 34 to move toward the respective nozzle 28 while the two aligned sealing elements 26 move nearer to each other on their way toward the testing station, and because the connection between the partition 34 and the respective tubular section 38 also includes a weakened annular portion or membrane 37 of reduced thickness enabling the section 38 to contract in the region of the lip 42 while the partition 34 moves toward the nozzle 28 under the action of the article 3, i.e. while the article 3 causes the partition 34 to reduce the overall length of the sealing element 26. The sections 38 resemble hollow conical frusta and their outer diameters decrease in directions away from the respective partitions 34, i.g., toward the respective lips 42. The internal surfaces 39 of the sections 38** are cylindrical prior to displacement of the partitions 34, and the diameters of such internal surfaces slightly exceed the diameter of an article 3 prior to movement of the lips 42 into sealing engagement with the external surface 3*a* of the article between the corresponding sealing elements 26.

The membranes 42 and 37 can be said to constitute portions of the respective tubular sections 27 and 38 of a sealing element 26. These tubular sections together constitute a tubular body whose length is reduced when the partition 34 is caused to move in the direction of arrow X shown in FIG. 2.

Referring again to FIG. 1, the swash plates 21 are provided with coupling pins 44 extending with clearance into recesses 46 provided therefor in the corresponding end faces of the conveyor 1. The width of the recesses 46 (as considered in the radial direction of the conveyor 1) exceeds the diameters of the coupling pins 44 so that the swash plates 21 are free to wobble with reference to the conveyor 1 while the latter rotates about the axis of the drive shaft 9. The surfaces surrounding the recesses 46 and the coupling pins 44 constitute a means for transmitting torque from the conveyor 1 to the two swash plates 21. Springs 47 are installed between the two end faces of the conveyor 1 and the swash plates 21; these springs serve to urge the outer sides of the swash plates 21 against the surfaces 24 of the respective valve plates 22. The springs 47 store energy during movement toward the testing station between the valve plates 22 and they dissipate some energy during movement away from the testing station.

The nipples 31 receive testing fluid from a supply conduit 48 which contains a pressure gauge 49, a flow restrictor 51 which is installed upstream of the gauge 49, and a valve 52 which is installed upstream of the flow restrictor 51. The source of gaseous testing fluid is not shown; as a rule, the testing fluid is compressed air.

The illustrated testing apparatus is designed in such a way that it admits streams of gaseous testing fluid into both ends of the article 3 which advances past the testing station. However, it is equally possible to admit testing fluid only into one end of the article which advances past the testing station or to draw testing fluid from one end of such article while the other end communicates with the atmosphere. Reference may be had to aforementioned commonly owned U.S. Pat. No. 4,177,670 to Heitmann et al.

Figure 2:
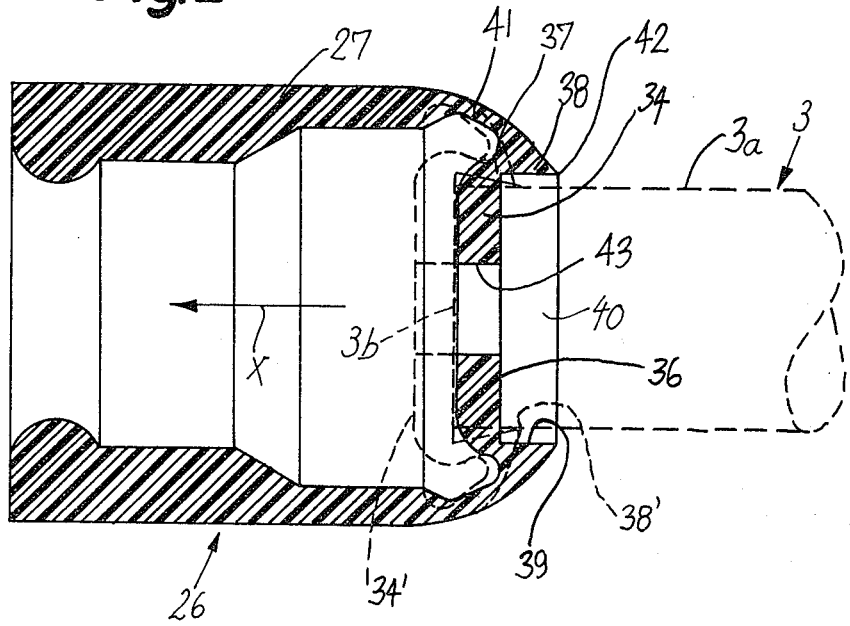
FIG. 2 is a greatly enlarged axial sectional view of a sealing element, an article to be tested and a deformed section of the sealing element being indicated by broken lines.

The operation of the testing apparatus which embodies the improved sealing elements 26 is as follows:

The shaft 9 receives torque from the main prime mover of the filter tipping machine (see the element PM in FIG. 1 of U.S. Pat. No. 4,177,670). The shaft 9 drives the conveyor 1 by way of the flange 11 and bolts 12 so that the parts 1 and 9 rotate as a unit. The channel 4 is connected with the suction generating device which draws air from the suction ports 6 so that the articles 3 which are admitted into successive sets of flutes 2 upstream of the testing station adhere to the respective portions of circumferential ribs 2*a* on the conveyor 1. The station where the articles 3 are inserted into the flutes 2 is located in the region where the distance between a pair of aligned sealing elements 26 suffices to place an article 3 therebetween, i.e., such inserting station is located in a region where the distance between the lips 42 of two aligned sealing elements 26 exceeds the length of an article 3. As the sealing elements 26 thereupon advance from the inserting station toward the testing station, the partitions 34 of a pair of aligned sealing elements 26 move toward each other and engage the respective end faces 3*b* of an article 3 therebetween at least slightly ahead of the testing station, i.e., before the distance between such aligned sealing elements 26 is reduced to less than the length of a rod-shaped article 3. As the end portions of the article 3 which advances toward the testing station gradually penetrate into the sockets 40 within the respective tubular sections 38, the internal surfaces 39 initially spacedly surround the adjacent portions of the external surface 3*a*. The sealing elements 26 continue to advance toward the testing station whereby the swash plates 21 cause such sealing elements to move nearer to each other with the result that the outer sides 36 of the partitions 34 move against the respective end faces 3*b* and the article 3 deforms the corresponding sealing elements 26 by causing the sealing elements to buckle in the regions of the membranes 41 because the partitions 34 are urged toward the respective nozzles 28 (note the broken-line position 34′ of the partition 34 shown in FIG. 2). This, in turn, entails a deformation of the membranes 37 whereby the diameters of the originally cylindrical internal surfaces 39 decrease in the regions of the respective lips 42 with the result that the lips 42 sealingly engage the adjacent portions of the external surface 3*a* of the rod-shaped article 3 not later than when such article arrives at the testing station between the valve plates 22. The deformed position of the tubular section 38 forming part of the sealing element 26 shown in FIG. 2 is indicated at 38′. The lips 42 are relatively thin and soft so that they can sealingly engage the surface 3*a* and prevent penetration of atmospheric air into the wrapper of the article 3 and/or the escape of testing fluid from the interior of the sealing elements 26 into the surrounding atmosphere while the condition of the article 3 is tested during travel between the valve plates 22, i.e., while the grooves 33 admit testing fluid into the bores 32 whence the two streams of testing fluid flow into the ends of the article at the testing station. The gauge 49 indicates the pressure in the supply conduit 48, and such pressure drops if the wrapper of the article 3 at the testing station has a leak or if the annulus or annuli of intentionally formed perforations 53 in the wrapper of the filter mouthpiece 54 of the article 3 at the testing station establish a larger-than-desired path for the flow of atmospheric air into the column of tobacco smoke when the article 3 is lighted.

The partitions 34 offer minimal resistance to movement from their normal positions to the positions corresponding to that shown at 34′ in FIG. 2 because the material of the sealing elements 26 is preferably soft and the sealing elements 26 are weakened at 41 to enable the partitions 34 to yield when the swash plates 21 reduce the distance between two aligned partitions to that between the end faces 3*b* of an article 3 and the plates 21 thereupon continue to move the corresponding nozzles 28 nearer to each other.

The supply conduit 48 is further connected to a suitable transducer (see, for example, FIG. 4 of U.S. Pat. No. 4,177,670) which initiates automatic segregation of a defective article 3 from satisfactory articles so that the defective article cannot reach the consumer.

When a freshly tested article 3 advances beyond the testing station, the distance between the corresponding sealing elements 26 increases so that the partitions 34 are free to reassume their normal positions and the deformation of the tubular sections 38 gradually decreases to zero. The distance between the sealing elements 26 thereupon continues to increase so that the tubular sections 38 move axially of and away from the article 3 which is then free to be withdrawn from its flutes 2 at a removing station located ahead of the aforementioned inserting station. Suction in the ports 6 is terminated at the removing station so that the freshly tested articles 3 can be readily transferred into the flutes of a rotary drum-shaped removing conveyor either by suction or by resorting to mechanical stripping devices at the locus of transfer of articles from the conveyor 1 onto the removing conveyor.

The bottom walls of partitions 34 of the sealing elements 26 need not be deformable at all, i.e., they need not be flexed and/or otherwise deformed during displacement toward the respective nozzles (under the action of an article 3 therebetween) or in the opposite direction (due to innate tendency of the sealing elements 26 to reassume their undeformed conditions). All that counts is to ensure that axial displacement of the partitions 34 toward the respective nozzles 28 entails an appropriate deformation of the tubular sections 38 (i.e., a movement of the lips 42 into sealing engagement with the external surface 3*a* of an article 3 between two aligned sealing elements 26 which advance toward the testing station) and that such deformation of the sections 38 is terminated in automatic response to return movement of the corresponding partitions 34 to their normal positions. Thus, the outer sides 36 of the partitions 34 preferably remain flat so that they can move into face-to-face contact with the respective end faces 3*b* of an article 3. This further reduces the likelihood of escape of testing fluid which is admitted via apertures 43, i.e., such fluid is less likely to penetrate between the outer side 36 and the adjacent end face 3*b* of an article 3 which is being tested. Still further, the utilization of relatively rigid partitions 34 reduces the likelihood of undesirable deformation of the end portions of tubular wrappers of the articles 3 because the outer sides 36 remain flat while the partitions 34 move nearer to the respective nozzles 28.

The portions or membranes 41 of reduced thickness may but need not be provided in close or immediate proximity of the respective partitions 34; all that counts is to ensure that the partitions 34 can yield by moving toward the respective nozzles 28 when an article 3 approaches the testing station.

The axis of the normally cylindrical internal surface 39 of each tubular section 38 is preferably normal to the plane of the outer side 36 of the corresponding partition 34. The feature that the surfaces 39 are cylinders (in undeformed condition of the respective tubular sections 38) is desirable and advantageous because, in combination with the feature that the inner diameter of the surface 39 normally slightly exceeds the diameter of an article 3, such feature ensures that the end portions of articles 3 can readily enter the sockets 40 within the tubular sections 38 while the aligned sealing elements 26 move axially toward each other simultaneously with movement toward the testing station. When a tubular section 38 is deformed, its internal surface 39 is converted into a frustoconical surface whose smaller diameter equals the outer diameter of an article 3 and whose maximum diameter may but need not appreciably exceed the diameter of the article. The utilization of tubular sections 38 whose cross sections resemble wedges tapering toward the respective lips 42 has been found to contribute to a more reliable and predictable sealing action between the lips 42 and the external surfaces 3*a* of the articles 3 to be tested.

The swash plates 21 contitute but one form of means for moving aligned sealing elements 26 toward and away from each other while the sealing elements respectively advance toward and away from the testing station. Thus, and as disclosed in U.S. Pat. No. 3,769,832, each nozzle 28 can be mounted for axial movement in flanges which are rigidly connected with the conveyor, and each such nozzle is then provided with a roller follower which tracks the face of a suitable cam which is fixedly mounted in the frame of a tobacco processing machine and is adjacent to the respective end of the testing conveyor. The swash plates which are shown in FIG. 1 are preferred at this time because they contribute to simplicity and reliability of the testing apparatus.

An important advantage of the improved apparatus is that the sealing elements 26 automatically undergo the necessary deformation to sealingly engage an article 3 therebetween without resort to discrete deforming means, such as pneumatic devices which inflate the sealing elements on engagement with the articles to be tested, mechanical deforming devices or the like. Instead, the sealing elements 26 are automatically deformed by the articles to be tested so that they invariably engage and seal the articles not later than on arrival at the testing station. The absence of discrete deforming means for the sealing elements simplifies the testing apparatus and contributes to lower initial and maintenance costs. Furthermore, the testing apparatus is less prone to malfunction, especially since the material of the sealing elements 26 as well as the extent of wobbling movement of the swash plates 21 can be readily selected in such a way that the lips 42 can properly engage and seal articles whose diameters fluctuate within a certain range. The axial movements of partitions 34 invariably entail such contraction of the sections 38 in the region of the lips 42 that the internal surface 39 of each section 38 engages and seals the adjacent portion of the external surface 3*a* of an article 3 which is about to reach the testing station. Analogously, the deformation of tubular sections 38 is terminated in automatic response to transport of a freshly tested article 3 away from the testing station.

Another important advantage of the improved testing apparatus is that it is capable of testing the articles at a much higher frequency than heretofore known testing apparatus. This is due to the absence of discrete deforming means for the sealing elements, i.e., the sealing elements 26 are deformed and allowed to reassume their undeformed states at the (high or low) frequency at which the conveyor 1 transports articles 3 toward, past and beyond the testing station. In many conventional testing apparatus, such frequency is limited by the frequency at which the discrete deforming means can deform the sealing elements per unit of time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an apparatus for testing cigarettes or analogous rod-shaped articles, the combination of an article transporting conveyor; at least one sealing element movable in synchronism with said conveyor and including a partition and an elastic tubular section adjacent to and defining with said partition a socket for one end of an article on said conveyor, said section having an internal surface surrounding said socket and being contractible as a result of deformation and attendant reduction of the inner diameter of said section in response to displacement of said partition in a predetermined direction; and means for effecting a relative movement between said conveyor and said sealing element so as to introduce one end of an article on said conveyor into said socket and to thereupon cause the thus introduced end of the article to move said partition in said direction whereby said internal surface sealingly engages the external surface of the article.

2. The combination of claim 1, wherein said sealing element includes a substantially annular weakened portion disposed intermediate said partition and said tubular section to enhance the deformability of said section in response to movement of said partition in said predetermined direction.

3. The combination of claim 1, wherein said sealing element further comprises a second tubular section, said partition being disposed between said tubular sections and said sealing element further including an elastically deformable weakened portion connecting said tubular sections with one another to reduce the resistance which the introduced end of the article on said conveyor encounters while moving said partition in said direction.

4. The combination of claim 1, wherein said sealing element further includes a second tubular section and said partition is disposed between said tubular sections, said sealing element further comprising deformable first and second annular membranes respectively disposed between said first mentioned tubular section and said partition and between said tubular sections.

5. The combination of claim 4, wherein the thickness of each of said membranes, as considered radially of said tubular sections, is a small fraction of the thickness of the respective tubular sections.

6. The combination of claim 1, wherein said partition has a substantially flat outer side facing said socket and said internal surface is a cylindrical surface whose axis is at least substantially normal to the plane of said outer side in undeformed condition of said tubular section.

7. The combination of claim 6, wherein said cylindrical surface is converted into a frustoconical surface whose diameter decreases in a direction away from said partition in response to displacement of said partition in said predetermined direction.

8. The combination of claim 1, wherein said tubular section has a substantially wedge-like cross-sectional outline and its thickness decreases in a direction away from said partition.

9. The combination of claim 1, wherein said partition has an aperture for the passage of a fluid therethrough.

10. The combination of claim 1, wherein said means for effecting said relative movement includes a swash plate adjacent to said conveyor and supporting said sealing element.

11. The combination of claim 10, wherein said conveyor is rotatable about a predetermined axis and further comprising means for coupling said swash plate to said conveyor for rotation about said axis.

12. As a novel article of manufacture, particularly for use in testing apparatus for cigarettes or like rod-shaped articles, a sealing element including a tubular body having elastic first and second tubular sections, and a transverse partition disposed in said body between said sections, said partition being movable substantially axially of said sections by the articles about to be tested so as to reduce the overall length of said tubular body and one of said sections being contractible radially in response to such axial movement of said partition, said partition and said one section defining a socket and said partition having a substantially flat side engageable by the articles to be tested and facing said socket, said one section having an internal surface which surrounds said socket and is at least substantially cylindrical in undeformed condition of said one section.

13. The sealing element of claim 12, wherein said tubular sections include relatively thin and readily deformable annular portions one of which connects said partition with said one tubular section and the other of which connects said tubular sections to each other, said annular portions being deformed in response to said axial movement of said partition.

14. The sealing element of claim 12, wherein the rigidity of said partition exceeds the rigidity of said one tubular section.

15. The sealing element of claim 12, wherein said one tubular section has a substantially wedge-like cross-sectional outline and its thickness decreases in a direction away from said partition.

16. The sealing element of claim 12, wherein said partition has a substantially centrally located aperture.

17. The sealing element of claim 12, wherein said tubular sections and said partition consist of rubber or a similar elastomeric material.

* * * * *